US006060672A

United States Patent [19]

Sugihara

[11] Patent Number: 6,060,672

[45] Date of Patent: May 9, 2000

[54] PUSH BUTTON STRUCTURE

[75] Inventor: Reiji Sugihara, Tokyo, Japan

[73] Assignee: Aruze Corporation, Tokyo, Japan

[21] Appl. No.: 09/069,406

[22] Filed: Apr. 29, 1998

[30] Foreign Application Priority Data

Aug. 29, 1997 [JP] Japan ..... 9-234036

[51] Int. Cl.[7] ..... H01H 35/24

[52] U.S. Cl. ..... 200/61.1; 200/345; 250/229

[58] Field of Search ..... 250/221, 229; 200/61.1, 341, 345

[56] References Cited

U.S. PATENT DOCUMENTS

| | | | |
|---|---|---|---|
| 4,251,703 | 2/1981 | Hoeft et al. | 200/341 |
| 4,479,111 | 10/1984 | Madsen et al. | 341/27 |
| 5,173,578 | 12/1992 | Tama | 200/345 |
| 5,228,561 | 7/1993 | Schroder et al. | 200/517 |
| 5,404,133 | 4/1995 | Moriike et al. | 340/815.56 |
| 5,545,866 | 8/1996 | Bulin et al. | 200/345 |
| 5,546,866 | 8/1996 | Bulin et al. . | |

FOREIGN PATENT DOCUMENTS

| | | |
|---|---|---|
| 196 27 213 | 11/1997 | Germany . |
| 93 13 277 U | 10/1999 | Germany . |

*Primary Examiner*—Edward P. Westin
*Assistant Examiner*—Glenn T Kinnear
*Attorney, Agent, or Firm*—Rohm & Monsanto, PLC

[57] ABSTRACT

A push button structure that is particularly suited for gaming equipment is tolerant of the spillage of food or beverage, or of continued operation thereof by individuals with soiled hands. The push button structure has an actuatable member having an outwardly extending flange and a manipulable portion. A retaining member is provided with an opening through which is exposed the manipulable portion of the actuatable member. A protrusion is formed on the inner surface of the retaining member or on the outer surface of the outwardly extending flange of the actuatable member to prevent the surfaces from communicating with each another over a large contact area. The reduction in the contact area reduces the strength of adhesion therebetween resulting from the contaminants.

12 Claims, 6 Drawing Sheets

PUSH BUTTON STRUCTURE

BACKGROUND OF THE INVENTION

1. Field of the Invention

This invention relates generally to push button structures, and more particularly, to a structure for a push button switch for use with instruments or machines, particularly gaming machines.

2. Description of the Related Art

In a conventional gaming machine, such as a slot machine, the rotation of a plurality of reels is stopped in response to the actuation of push button switch by a player. The winning of a prize may be lost by a momentary delay in the operation of push button switch. Quickness in the operation of the push button switch influences the results that can be achieved in the playing of the game.

It is a problem in commercial amusement centers that players will operate the gaming machines while foreign substances are on their hands. The foreign substances are present, for example, because the equipment is often operated while the players are eating or drinking. Thus, the operation of gaming machines, particularly the actuation of the push buttons thereof, with soiled hands results in contaminating material, such as food and beverage, entering into the gaps surrounding the actuation portion of the push button, and the push button itself being soiled. Food and beverage often are spilled directly on the push buttons of the gaming equipment. Insects are another cause of contamination of the push buttons of such machines. Insects easily enter and die in the gaps that surround the push button. These and other contaminating elements result in erratic operation of the button operation and loss of player control over the game.

When it is determined that the actuation of the push button cannot smoothly be performed or its operation adequately controlled by the operator, the push button unit must be removed from the gaming machine and cleaned. Such maintenance is expensive and troublesome, and results in significant machine down time. In addition, erratic or difficult operation of the gaming machine causes the players to lose interest in the game and the gaming machine itself, resulting in loss of clientele to the gaming establishment and low utilization efficiency for the equipment.

There is therefore, a need for a push button structure that is tolerant of contaminants. The prior art has thrust at this problem by providing a push button structure that has an outwardly extending flange over which is provided a retaining member. This button structure prevents some contaminating materials from entering the gap between the actuation portion of the push button and the retaining board. However, in this structure, when food or drinks spill or otherwise are deposited on the push button, the contaminants penetrate into the gap between the outwardly extending flange and the retaining member. These contaminants cause adhesion between the outer surface of the outwardly extending flange of the push button and the inner surface of the retaining member. Consequently, a greater magnitude of actuation force is required to be applied by the player to the actuation portion of the push button to operate the gaming equipment, resulting in difficulty for the player in controlling the game being played, early onset of fatigue, and ultimately player dissatisfaction.

SUMMARY OF THE INVENTION

It is, therefore, an object of the present invention to provide a push button structure that is tolerant of food and/or beverage spills thereon, and of the effects of players that play with soiled hands.

The foregoing and other objects are achieved by this invention which provides a push button structure having an actuatable member having a manipulable portion and an outwardly extending flange projecting therefrom. A retaining member has an opening therethrough to expose the manipulable portion of the actuatable member. A protrusion is formed on either the inner surface of the retaining member or the outer surface of the outwardly extending flange of the actuatable member to prevent the surfaces from having wide contact area. Such reduction in the contact area results in diminished adhesion between these parts when food, beverage, or other contaminant has been spilled thereon.

The protrusion forms a space between the retaining member and the outwardly extending flange which serves to separate one from the other. Therefore, if food or drink spills onto the push button structure, the outwardly extending flange will not readily adhere to the retaining member. As a result, impairment of the functionality of the push button structure in response to contamination is minimized.

The actuating force that is applied to the manipulable portion of the actuatable member is distributed equally throughout the outwardly extending flange and the retaining member by the small continuous surface area formed by the contact surface reducing portion. Thus, even if the contaminants cause the small continuous contact surfaces to adhere, only a slight force is required to separate them.

In embodiments where a tip is arranged to project from the top surface of the protrusion, the area of contact between the outwardly extending flange and the retaining member is correspondingly decreased.

In accordance with an advantageous embodiment of the invention, a push button structure is provided with an actuatable member having a manipulable portion arranged to be pushed by an operator. A tube is arranged to extend from the manipulable portion in the direction to be pushed, and an outwardly extending flange is provided. In one embodiment, the outwardly extending flange is formed intermediate of the manipulable portion and the tube. A retaining member is provided having an opening through which is exposed the manipulable portion of the actuatable member. A protuberance is arranged in the core space of the tube and functions as a guide for the movement of the actuatable member. Additionally, a switching element which initiates a change in response to movement of the actuatable member functions directly or indirectly to produce an electrical response responsive to the pushing of the manipulable portion. The actuatable member is restored to its original position after being pushed and released by the operator by restoring force of a resilient element, such as a spring. A protrusion is formed on inner surface of the retaining member or on outer surface or the outwardly extending flange of the actuatable member to prevent the surfaces from having a large contact area. The protuberance is disposed within a recess in a support element.

In this embodiment, the protuberance of the support element is inserted into the core space of the tube of the actuatable member. In this manner, inner surface of the tube looks external face of the protuberance, so that both surfaces are isolated from the contamination from the outside. Therefore, if an operator spills food or beverage, such contaminants will not enter therebetween. In addition, as previously noted, the protuberance functions as a guide for the movement of the actuatable member. In this regard, the space between the internal surface of the tube and the external surface of the protuberance may be adjusted to effect a stable movement of the actuatable member, eliminating vibration.

When a considerably large amount of space is provided between outer surface of the tube and surface of the recess where protuberance engages with the tube of the actuatable member, any food or beverage that is spilled on the push button assembly, or any other contamination that would pass through the space to the bottom of the recess, will not disturb the operation of the push button structure.

A switching arrangement, illustratively in the form of a photoelectric system, will provide an electrical response to the actuation of the actuatable member. In a specific illustrative embodiment of the invention, a photo-sensor arrangement provides an optical path that is interrupted in response to the movement of the actuatable member. In other embodiments, conductive switching contacts can be employed. Thus, the push button structure of this invention can produce an effective switching action.

In embodiments of the invention where a penetration aperture is formed through the core of the protuberance, a lighting member such as a light-emitting diode, is positioned in the actuatable member through the penetration aperture of the protuberance to illuminate the manipulable portion.

BRIEF DESCRIPTION OF THE DRAWING

The foregoing and other objects, features, and advantages of the invention will become more apparent from the following detailed description taken in conjunction with the accompanying drawing figures, in which.

DETAILED DESCRIPTION

Figure 1:
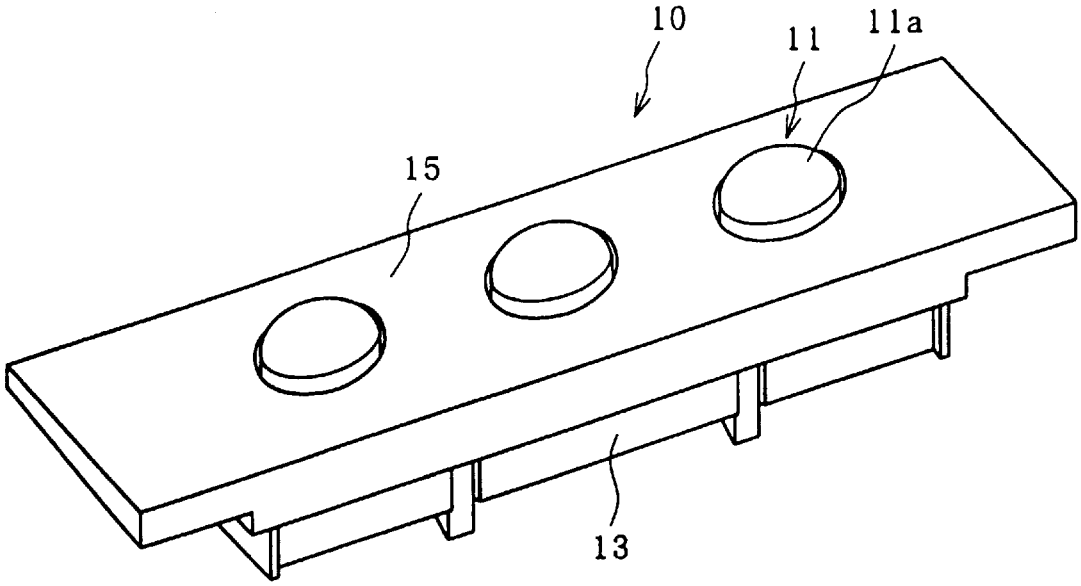
FIG. 1 is an isometric representation of an illustrative push button structure constructed in accordance with the principles of the invention.

FIG. 1 is an isometric representation of a specific illustrative embodiment of the push button structure of the present invention. As shown in this figure, a push button structure 10 has three actuatable members 11 in the form of push buttons, each such push button having a manipulable portion 11*a*. A box-shaped supporting member 13 accommodates the actuatable members, and a retaining member 15 overlies and covers the supporting member 13. Switching arrangement (not shown in this figure) is contained within the supporting member 13, as will be described below in detail.

Figure 2:
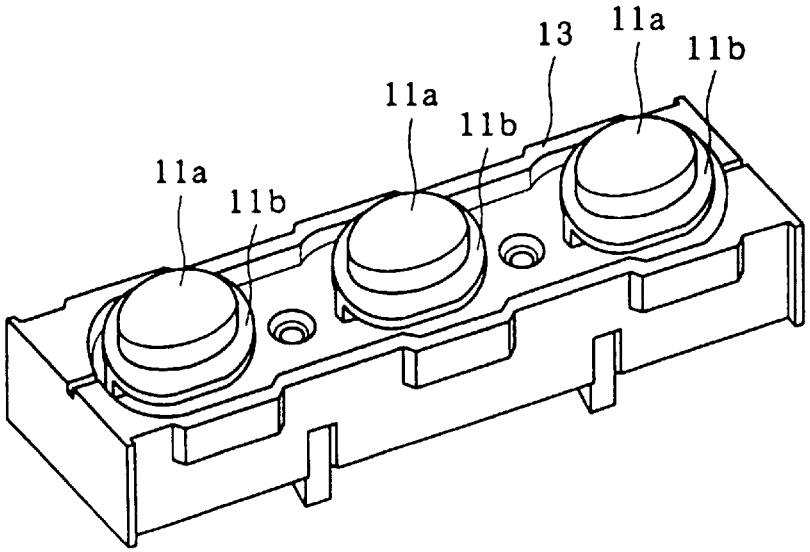
FIG. 2 is an isometric representation of the push button structure of FIG. 1, with the retaining member removed therefrom.

FIG. 2 is an isometric representation of the push button structure of FIG. 1 with the retaining member removed therefrom. This figure illustrates the portion of the supporting member that underlies the retaining member. As shown, each actuatable member 11 has an outwardly extending flange 11*b* expanding horizontally below its respectively associated the manipulable portion 11*a* and is installed on the supporting member 13. Accordingly, when assembled for use, the outer surface of the outwardly extending flange 11*b* communicates with the inner surface of the retaining member 15 (not shown in this figure).

Figure 3:
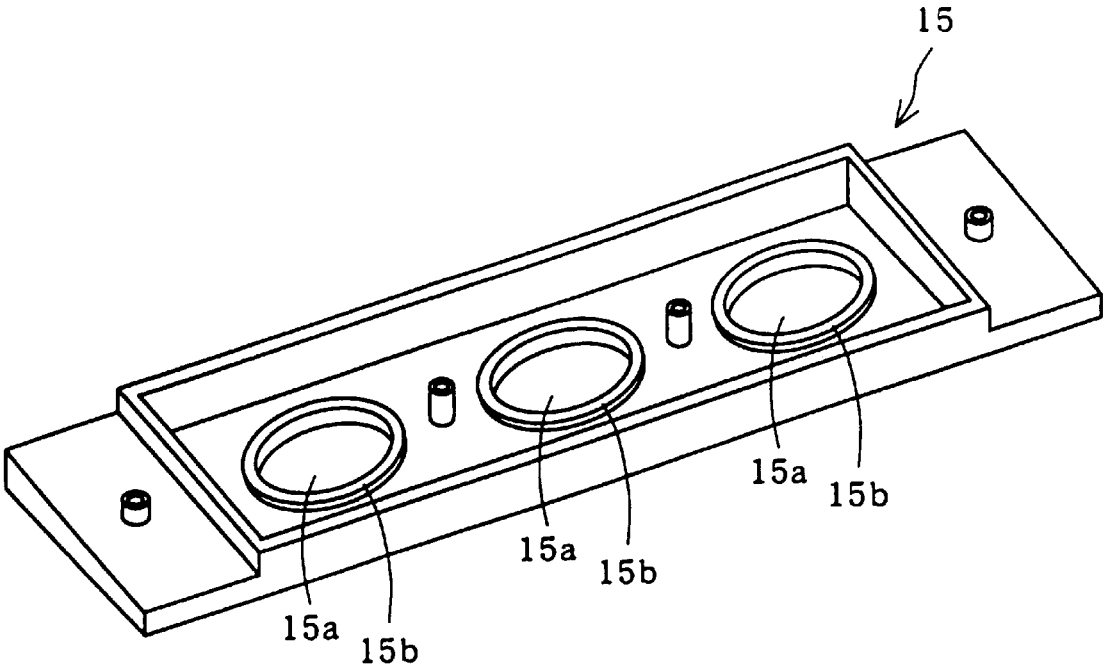
FIG. 3 is an isometric representation of the underside of the retaining member.

FIG. 3 is an isometric representation of the retaining member 15 showing the underside thereof. As shown in this figure, the retaining member 15 has three openings 15*a* therethrough arranged to register with respective actuatable members 11 to expose the manipulable portions 11*a* of the actuatable members 11.

Additionally, the retaining member 15 has respective continuous narrow protrusions 15*b* projecting along the periphery of each opening 15*a*.

Figure 4:
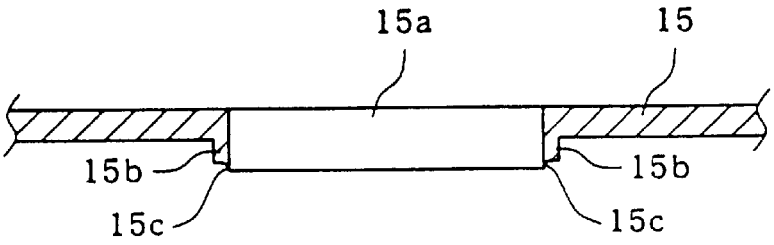
FIG. 4 is a partially cross-sectional plan representation of the retaining member of the embodiment of FIG. 1.

FIG. 4 is a partially cross-sectional representation of the retaining member 15 showing one of the openings 15*a* therethrough in greater detail. A tip 15*c* is projecting from inner peripheral edge of the protrusion 15*b*.

Figure 5:
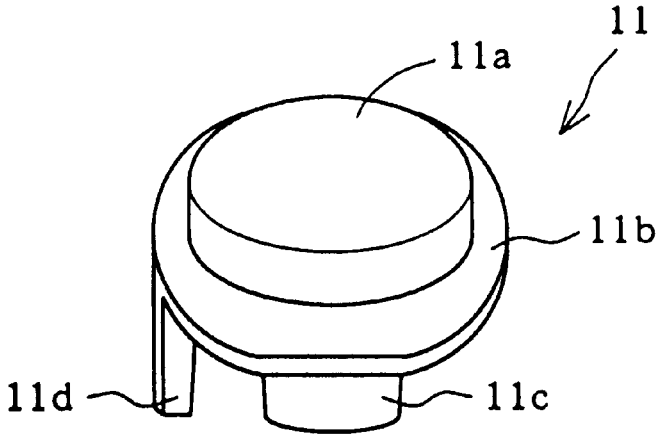
FIG. 5 is an isometric representation of the actuatable member of the push button embodiment of FIG. 1.

FIG. 5 is an isometric representation of the actuatable member 11. As shown, the actuatable member 11 has a substantially cylindrical portion 11*c*, substantially in the form of a tube, and arranged to extend beneath outwardly extending flange 11*b*. Additionally, there is shown in this figure a light path shut-off portion lid that is shaped as a protuberance that projects downward from the inner surface of the outwardly extending flange 11*b*. The operation of this light path shut-off portion will be described below in detail.

Figure 6:
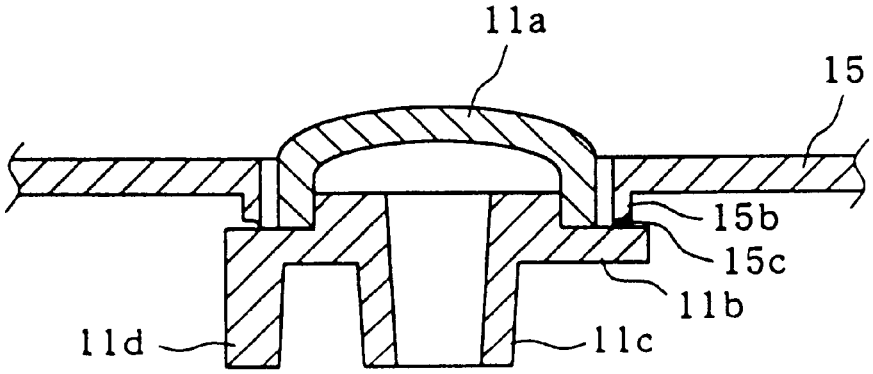
FIG. 6 is cross-sectional plan representation of the retaining member engaged with the actuatable member of the embodiment of FIG. 1.

FIG. 6 is a cross-sectional plan representation of the retaining member 15 engaged with the actuatable member 11. This figure illustrates the manner in which the outwardly extending flange 11*b* of the actuatable member 11 communicates with the underside (inner surface) of the retaining member 15. In this figure, the continuous protrusion 15*b* communicates with the outer (upper) surface of the outwardly extending flange 11*b* of each actuatable member via tip 15*c* which projects from the continuous protrusion 15*b* along the inner periphery of the opening 15*a*. As can be seen, only the tip 15*c* communicates with the outer (upper) surface of the outwardly extending flange 11*b* of the actuatable member 11 in this specific illustrative embodiment of the invention. Accordingly, even if this portion were to become contaminated by food, beverage, or other contaminants, so as to acquire an adhesive characteristic, the region over which such adhesion would occur is very narrow, and therefore only a very slight force is required to be applied on the manipulable portion 11*a* to effect separation of the peripheral edge from the outwardly extending flange.

Figure 7:
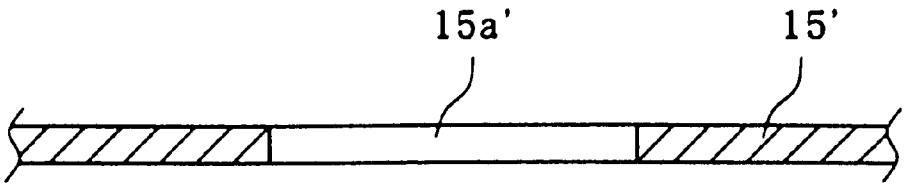
FIG. 7 (PRIOR ART)
FIG. 7 is a partially cross-sectional representation of a conventional retaining member.
Figure 8:
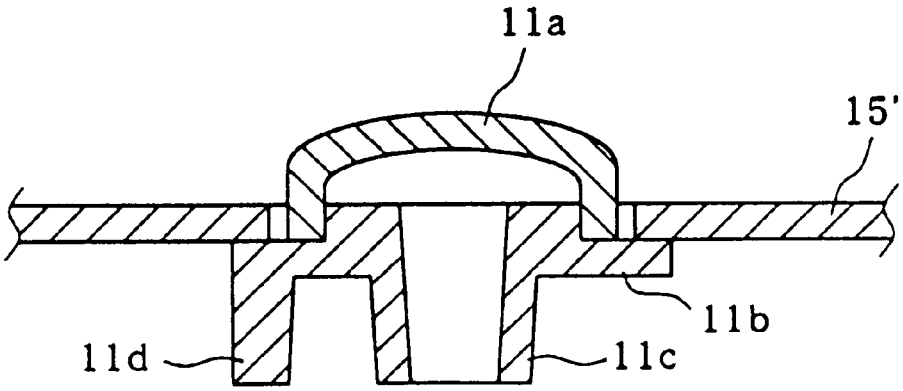
FIG. 8 (PRIOR ART)
FIG. 8 is a cross-sectional representation of the conventional retaining member of FIG. 7 and the actuatable member of FIG. 5 engaged therewith.

FIG. 7 is a partially cross-sectional representation of opening 15*a*' through a conventional retaining member 15'. In this retaining member, there is not provided a protrusion formed on the inner surface thereof. Therefore, in this arrangement, the total area of the outer surface of the outwardly extending flange 11*b* of the actuatable member 11 is in contact with the inner surface of the retaining member 15' as shown in the cross-sectional representation of FIG. 8. When any portions of the communicating surfaces become contaminated, as previously mentioned, adhesion takes place over the surface areas in contact. In this arrangement, a significant actuation force is required to be applied to separate the outer surface of the outwardly extending flange 11*b* from the inner surface of the retaining member 15'. Thus, push button operation cannot be performed smoothly.

Figure 9:
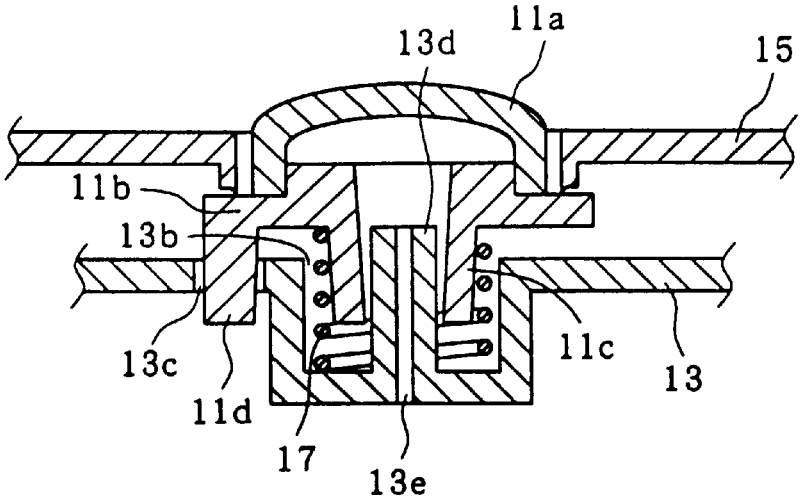
FIG. 9 is a partially cross-sectional representation of the embodiment of FIG. 1 showing additional internal structural elements.

FIG. 9 is a partially cross-sectional representation of a structure that has been constructed to effect a switch function. In this specific illustrative embodiment of the invention, the actuatable member 11, the support element 13, and a retaining member 15, are configured as described hereinabove. The actuatable member 11 is shown to be provided with a light path shut-off portion 11*d*, which as previously described in connection with FIG. 5, is configured as a protuberance that project downward (inward) from the inner surface of the outwardly extending flange 11*b*.

The support element 13 is shown in FIG. 9 to have a recess 13*b* in which the substantially cylindrical portion 11*c* of the actuatable member 11 readily is accommodated. A protuberance 13*d* projects upward (outward) from the bottom central region of recess 13*b*. Additionally, the support element has an aperture 13*c* that accommodates the light shut-off portion 11*d* of the actuatable member 11. The light shut off portion is shown to be inserted through the aperture 13*c*.

The outside diameter of protuberance 13*d* is slightly smaller than the inside diameter of the substantially cylindrical portion 11*c*. When the manipulable portion is pushed, the substantially cylindrical portion 11*c* can be translated smoothly along the protuberance 13*d* without vibration. The protuberance functions as a guide for the movement of actuatable member 11. The substantially cylindrical portion 11*c* is shown to be surrounded by a coil spring 17 and disposed directly over the protuberance 13*d* in the recess 13*b* of the support element 13. The light shut-off portion 11*d* is inserted through the aperture 13*c*.

The retaining member 15 limits the outward extent that the outer surface of the outwardly extending flange 11*b* travels. The actuatable member 11 is retained by the retaining member 15 in an outward most condition in response to the restoring force applied by the coil spring 17.

Figure 10:
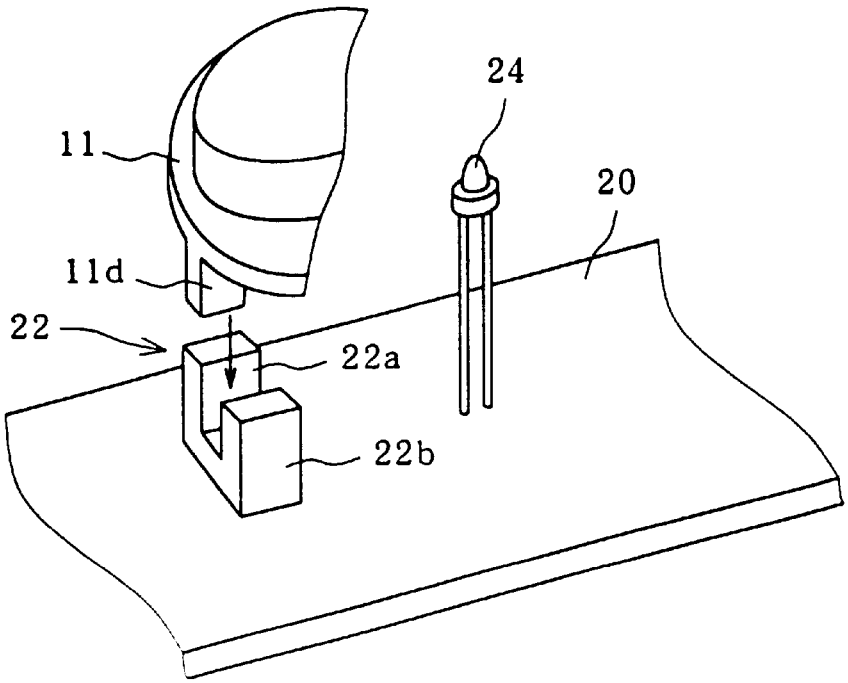
FIG. 10 is a partially fragmented isometric representation illustrating elements of structure that perform the switching function.

FIG. 10 is an isometric representation of a base 20 equipped with members which fulfill a switching function by movement of the light shut-off portion 11*d* of the actuatable member 11 in the above-mentioned push button structure. As shown, the base 20 is equipped with a U-shaped photo-sensor 22 that forms an optical path between portions 22*a* and 22*b*. These portions, in this specific illustrative embodiment of the invention, function as photodiode and photo-sensor, respectively. The optical path (not specifically designated) is between portions 22*a* and 22*b*. For sake of clarity of the description, a necessary wiring is not shown, and may be provided on the underside of the base 20. When the light shut-off portion 11*d* enters between the portions 22*a* and 22*b*, the optical path is interrupted.

In addition, the base 20 may, in some embodiments of the invention, be provided with a lighting member, such as a light-emitting diode 24 which illuminates the push button from the underside thereof.

In the above-mentioned structure, when the manipulable portion 11*a* of the actuatable member 11 is pushed down against the force of the coil spring 17, the light shut-off portion 11*d* of the actuatable member 11 also moves downward to interrupt and thereby shut off the optical path of the photo-sensor 22. A corresponding electrical signal (not shown) is produced by the photo-sensor 22. When the actuation force is eliminated, the actuatable member 11 returns to its former position in response to the restoring force of the coil spring 17, and the light shut-off portion 11*d* moves upward. The electrical signal from the photo-sensor 22 returns to its original condition. Thus, the light shut-off portion and photo-sensor 22 constitute a switching arrangement that is synchronized with movement of the push button.

In this specific illustrative embodiment of the invention, the recess 13*b* of the support element 13 has an inner diameter which is significantly larger than the outside diameter of the substantially cylindrical portion 11*c*. In this embodiment, the coil spring 17 is accommodated in this extra space, but the significant additional space remains. Such additional space is useful for contaminants, such as food, drink, dead insects that enter therein to pass to the bottom of the recess 13*b*. In a still further embodiment, a plurality of outlet apertures (not shown) is formed on the bottom surface of the recess 13*b*. Contaminants such as food and drink are discharged through such outlets.

As shown in FIG. 9, the protuberance 13*d* has a penetration aperture 13*e* extending through its core, the protuberance 13*c* which is projecting from the center of bottom surface of the recess 13*b* of the supporting member 13. In a specific illustrative embodiment of the invention, the lighting member 24 is inserted therethrough to illuminate the actuatable member 11.

When the manipulable portion 11*a* is pushed, the actuatable member 11 is moved downward. During the movement of the actuatable member, the protuberance 13*d*, as previously noted, serves as a guide and ensures stability during the movement of the actuatable member 11.

In some embodiments of the invention, the switching portion of the arrangement may include electrical contacts, such as a leaf switch, wherein the electrical terminals are urged into, or out of, electrical communication in response to the actuation of the push button. Alternatively, a protrusion may be formed on the outer surface of the outwardly extending flange of the actuatable member, instead of on the inner surface of the retaining member of the above-mentioned embodiment.

Figure 11:
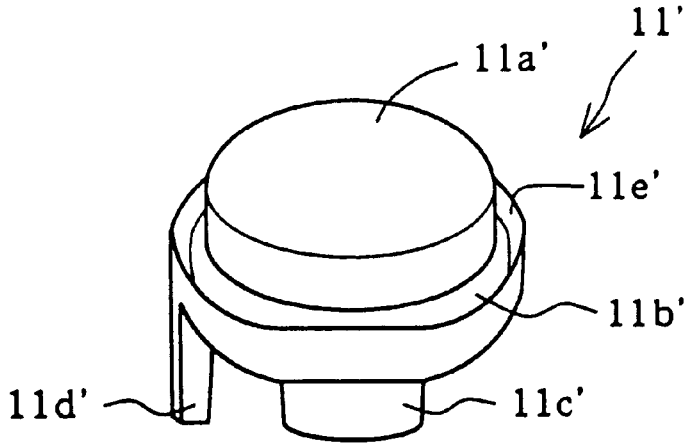
FIG. 11 is an isometric representation of a further embodiment of an actuatable member of a push button in accordance with the invention.

FIG. 11 is an isometric representation of a further embodiment of the invention. As shown, an actuatable member 11' constitutes the push button structure of this invention. The Actuatable member 11' is provided with a manipulable portion 11*a*', an outwardly extending flange 11*b*', a substantially cylindrical portion 11*c*' and a light shut off portion 11*d*', all of which are similar to corresponding elements described hereinabove with respect to the actuatable member 11. In the actuatable member 11', however, a continuous narrow protrusion 11*e*' is formed on a periphery of outer surface of the outwardly extending flange 11*b*'.

Figure 12:
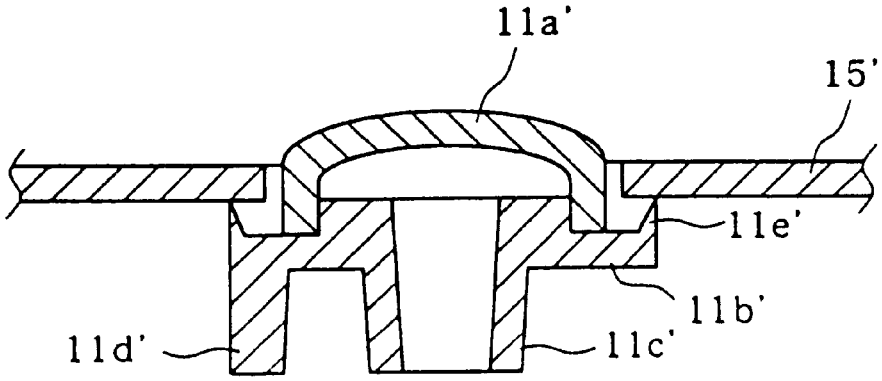
FIG. 12 is cross-sectional representation of the retaining member and the actuatable member of FIG. 11.

FIG. 12 is a partially cross-sectional representation of an embodiment of the invention wherein the outwardly extending flange 11*b*' of the actuatable member 11' is retained by the conventional retaining member 15'. The continuous protrusion 11*e*' prevents the inner surface of the retaining member 15' and the outer surface of the outwardly extending flange 11*b*' of the actuatable member 11' from communicating over a large contact area, thereby precluding them from adhering each other.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

The entire disclosure of Japanese Patent Application No. 9-234036 filed on Aug. 29, 1997 including specification, claims, drawings and summary are incorporated herein by reference in its entirety.

What is claimed is:

1. A push button structure comprising:

an actuatable member having a manipulable portion for receiving an axially inward actuation force, and a flange that projects laterally outward from the manipulable portion, said actuatable member being displaceable between first and second positions in response to the axially inward actuation force;

a guide tube coupled to said actuatable member and extending axially inward;

a supporting guide element arranged to engage with said guide tube for controlling a direction of motion of said actuatable member between the first and second positions in response to the axially inward actuation force;

a retaining member having an opening through which is exposed the manipulable portion of said actuatable member; and a contact surface reducing portion formed on a selectable one of the inner surface of said retaining member and the outer surface of laterally projecting flange of said actuatable member, for forming a small continuous contact surface area between said actuatable member and said retaining member.

2. The push button structure of claim 1, wherein the contact surface reducing portion comprises a protrusion arranged to surround and seal the opening of the retaining member when said actuatable member is in the first position.

3. The push button structure of claim 2, wherein a continuous cross-sectional tip is integrally formed with, and arranged to project from the protrusion.

4. The push button structure of claim 1, wherein the contact surface reducing portion comprises an edge having a tapered cross-sectional configuration.

5. A push button structure comprising an actuatable member having a manipulable portion arranged to be pushed, said actuatable member being movable in the direction the manipulable portion is arranged to be pushed;

a guide tube extending from the manipulable portion in the direction said actuatable member is arranged to be pushed;

a flange arranged to extend outwardly from the manipulable portion, a retaining member having an opening through which is exposed the manipulable portion of said actuatable member;

a guide protuberance installed in a core of said guide tube and arranged to guide a motion of said actuatable member in response to the application of a pushing force on the manipulable portion thereof;

switch means for producing a variation in an electrical condition in response to said actuatable member being pushed;

a resilient restoration element for applying a restoration force that restores said actuatable member to an original position after same is pushed and released;

a protrusion formed on a selectable one of the inner surface of said retaining member and the outer surface of said flange of said actuatable member, for reducing a continuous contact area between said flange and said retaining member; and a support element having a recess therein for accommodating said guide tube.

6. The push button structure of claim 5, wherein said protrusion is formed to surround continuously the opening of said retaining member.

7. The push button structure of claim 6, wherein there is further provided a tip projecting from said protrusion.

8. The push button structure of claim 5, wherein said guide protuberance is provided with an aperture in its core oriented in the direction of movement of said actuatable member.

9. The push button structure of claim 8, wherein there is further provided illumination means arranged in the aperture for illuminating the manipulable portion of said actuatable element.

10. The push button structure of claim 5, wherein there is further provided:

light path interruption means coupled to said actuatable member; and photosensor switching means for forming a light path, the light path being interrupted by the light path interruption means in response to said actuatable member being pushed.

11. The push button structure of claim 5, wherein the recess of said support element accommodates therein loosely said guide tube of said actuatable member.

12. The push button structure of claim 1, wherein said contact surface reducing portion comprises a protrusion arranged to surround the laterally projecting flange of said actuatable member.

* * * * *